US006745957B2

(12) United States Patent
Parey

(10) Patent No.: US 6,745,957 B2
(45) Date of Patent: Jun. 8, 2004

(54) FIRE HOSE NOZZLE COMPRISING A SAFETY DEVICE TO PREVENT IT FROM BEING DISPLACED THROUGH THE ACTION OF THE WATER SUPPLYING IT

(75) Inventor: Didier D. Parey, Ramerupt (FR)

(73) Assignee: St-Mihiel S.A. (FR)

( * ) Notice: Subject to any disclaimer, the term of this patent is extended or adjusted under 35 U.S.C. 154(b) by 230 days.

(21) Appl. No.: 09/997,691

(22) Filed: Nov. 29, 2001

(65) Prior Publication Data

US 2002/0036243 A1 Mar. 28, 2002

(30) Foreign Application Priority Data

Aug. 12, 2000 (FR) ..... 00 15961

(51) Int. Cl.[7] ..... B05B 1/30

(52) U.S. Cl. ..... 239/569; 239/587.2; 239/587.6; 239/581.1; 239/285; 169/52; 137/459

(58) Field of Search ..... 239/587.2, 587.3, 239/587.6, 569, 570, 581.1, 285; 169/52, 51, 24, 91; 137/459, 460

(56) References Cited

U.S. PATENT DOCUMENTS 1,995,299 A 3/1935 Foulds
2,002,451 A 5/1935 Gray
3,972,364 A 8/1976 Brumm
5,174,547 A 12/1992 Vuillermoz
5,593,092 A * 1/1997 McMillan et al. ..... 239/587.2

FOREIGN PATENT DOCUMENTS

CA 2123142 11/1995
JP 10-295843 11/1998

* cited by examiner

*Primary Examiner*—Dinh Q. Nguyen
(74) *Attorney, Agent, or Firm*—Anthony J. Casella; Gerald E. Hespos

(57) ABSTRACT

A fire hose nozzle includes a safety device to prevent the nozzle from being displaced due to the action of the water supplied to the nozzle. The safety device includes a tubular body and a butterfly disc with two coaxial trunnions pivotally mounted on the body. The butterfly disc is movable inside the tubular body between an open position, in which the butterfly disc allows water to flow, and a closed position, in which the butterfly disc restricts this flow. An external control lever is integral with one of the trunnions. A trigger is borne by the control lever and bears against the ground. The trigger holds the butterfly disc in its open position when the control lever exerts a downwardly directed vertical force thereon due to the action of the water flowing over the butterfly disc.

9 Claims, 3 Drawing Sheets

FIRE HOSE NOZZLE COMPRISING A SAFETY DEVICE TO PREVENT IT FROM BEING DISPLACED THROUGH THE ACTION OF THE WATER SUPPLYING IT

BACKGROUND OF THE INVENTION

1. Field of the Invention

The present invention relates to a fire hose nozzle comprising a safety device to prevent the fire hose nozzle from being displaced due to the action of the water supplied to the fire hose nozzle.

2. Description of the Related Art

Water under pressure suddenly enters or flows through a fire hose nozzle by fits and starts, and subjects the fire hose nozzle to forces producing pressure surges of varying intensity.

Now, owing to the action of these pressures surges, the fire hose nozzle tends to move in an erratic fashion in relation to the ground, with a risk of injury to persons or of damage to objects located in the path of the fire hose nozzle.

SUMMARY OF THE INVENTION

The present invention proposes to remedy these drawbacks and, for this purpose, the invention provides a fire hose nozzle with a safety device to prevent the fire hose nozzle from being displaced due to the action of the water. The fire hose nozzle is characterised in that the safety device includes a tubular body designed to be connected to a water supply hose. The safety device also has a butterfly disc including two coaxial trunnions pivotally mounted on the tubular body on a horizontal axis extending perpendicularly to the direction of flow of the water. The butterfly disc is movable inside the tubular body between an open position, in which the butterfly disc allows the water to flow, and a closed position, in which the butterfly disc restricts this flow. The safety device further includes an external control lever integral with one of the trunnions, and a triggering mechanism borne by the control lever and bearing against the ground for holding the butterfly disc in its open position when the control lever exerts thereon, through the action of the water flowing over the butterfly disc, downwardly directed vertical force.

Thanks to these arrangements, any risk of the fire hose nozzle according to the invention moving in relation to the ground through the action of pressure surges produced by the water is totally precluded.

As soon as the nozzle moves in relation to the ground, whether vertically, horizontally, or in some other direction, the control lever ceases, in fact, to act vertically on the triggering means. Now, in the absence of this action, the water flowing through the tubular body immediately moves the butterfly disc from its open position to its closed position, which has the result of considerably reducing the water flow rate and of thus immobilising the nozzle practically at once.

According to one particular form of embodiment of the invention, the tubular body can have a circular cross-section and be traversed, for example diametrically, by the pivotal axis of the trunnions.

Advantageously, the part of the butterfly disc that is upstream of the pivotal axis of the trunnions, in relation to the direction of flow of the water, is directed downwards.

As the upstream part of the butterfly disc is inclined downwards, the water has a greater effect thereon, and can thus move it quickly from its open position to its closed position as soon as the triggering means ceases to be subjected to the action of a vertical force.

Preferably, the fire hose nozzle according to the invention comprises a stop which, when the water is not flowing, holds the butterfly disc in a rest position in which the triggering means is removed from the ground.

Thanks to this stop, the triggering device thus remains above the ground when the water is not flowing, and there is thus no risk of its being soiled or damaged when the nozzle is not in use.

The stop can advantageously be borne by the part of the butterfly disc that is downstream of the pivotal axis of the trunnions, in relation to the direction of flow of the water, and bear against the inner face of the tubular body to hold the butterfly disc in its rest position.

The stop is actually inside the body of the nozzle, and hence the stop is perfectly protected from any risk of damage from the outside.

To facilitate manufacturing operations and to reduce the cost price of the fire hose nozzle, the control lever can be provided with an orifice parallel to the pivotal axis of the trunnions, while the triggering device can consist of a rod ending in a hook inserted into the orifice in the control lever.

The rod can, furthermore, have, at its end opposed to that of the hook, an end-piece bearing against the ground when the butterfly disc is in open the position.

For an operator to be able to return the butterfly disc easily to its open position, the control lever can advantageously include an operating handle at its end opposed to that of the triggering means, with the operating handle then extending obliquely upwards when the butterfly disc is in its open position.

BRIEF DESCRIPTION OF THE DRAWINGS

One form of embodiment of the present invention will be described hereinafter by way of an in no way limitative example, with reference to the attached drawings, wherein.

DETAILED DESCRIPTION OF THE PREFERRED EMBODIMENTS

Figure 1:
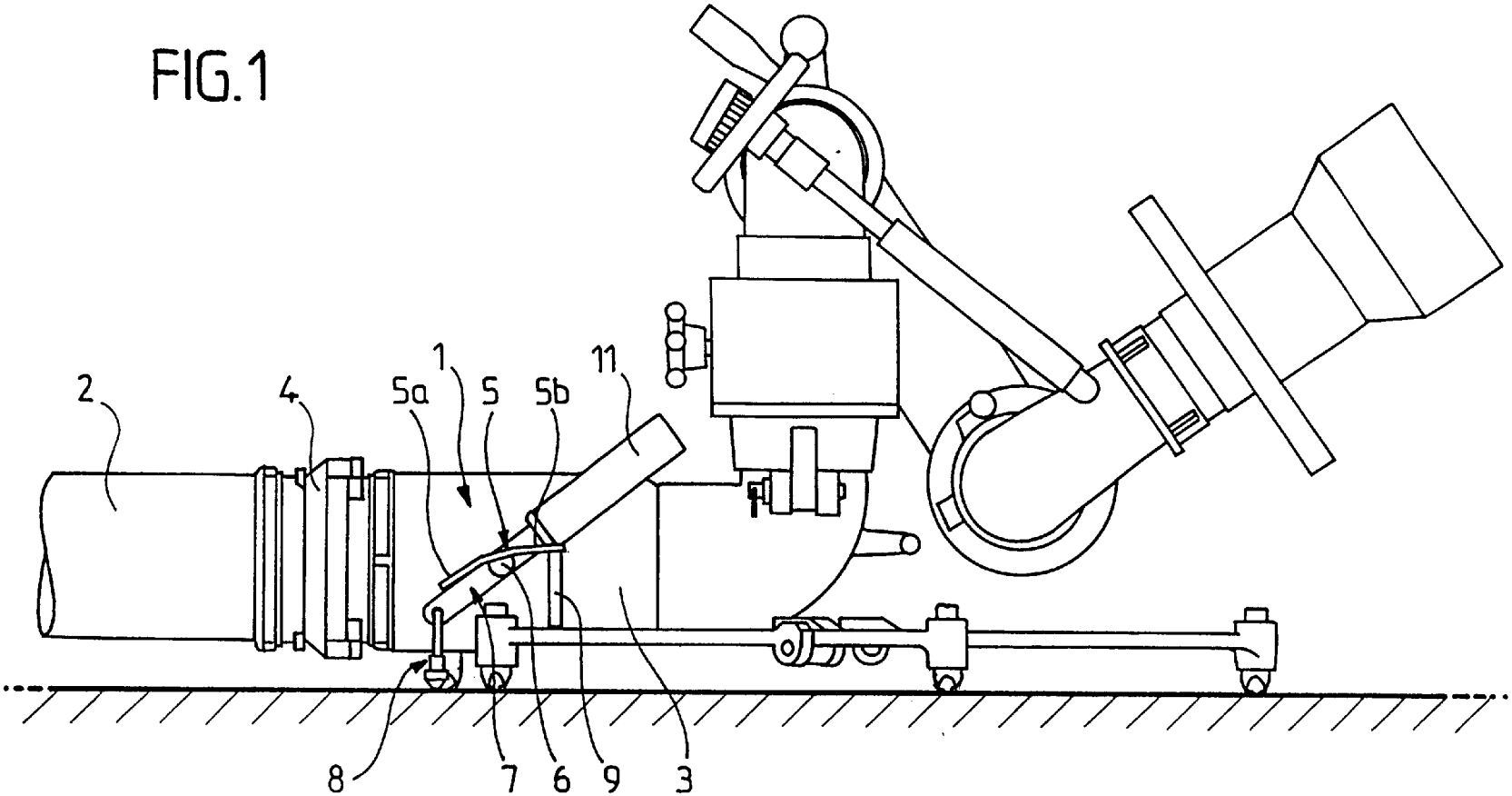
FIG. 1 is a diagrammatic side view of a fire hose nozzle according to the invention, this nozzle being fixed to the free end of a water supply hose.

The fire hose nozzle shown in FIG. 1 differs from conventional nozzles solely in respect of the safety device 1, which is provided at its inlet, and via which it is connected to a water supply hose 2.

Safety device 1 includes a tubular body 3 connected to hose 2 by a conventional fitting 4, this fitting being composed of two mating members borne respectively by tubular body 3 and hose 2.

Tubular body 3 contains a butterfly disc 5, moveable between an open position (visible in FIG. 3) in which it allows the water to flow, and a closed position (visible in FIG. 5), in which it restricts this flow.

Butterfly disc 5 is borne by two coaxial trunnions 6 pivotally mounted on tubular body 3, on a horizontal axis extending perpendicularly to the direction of flow of the water.

Figure 2:
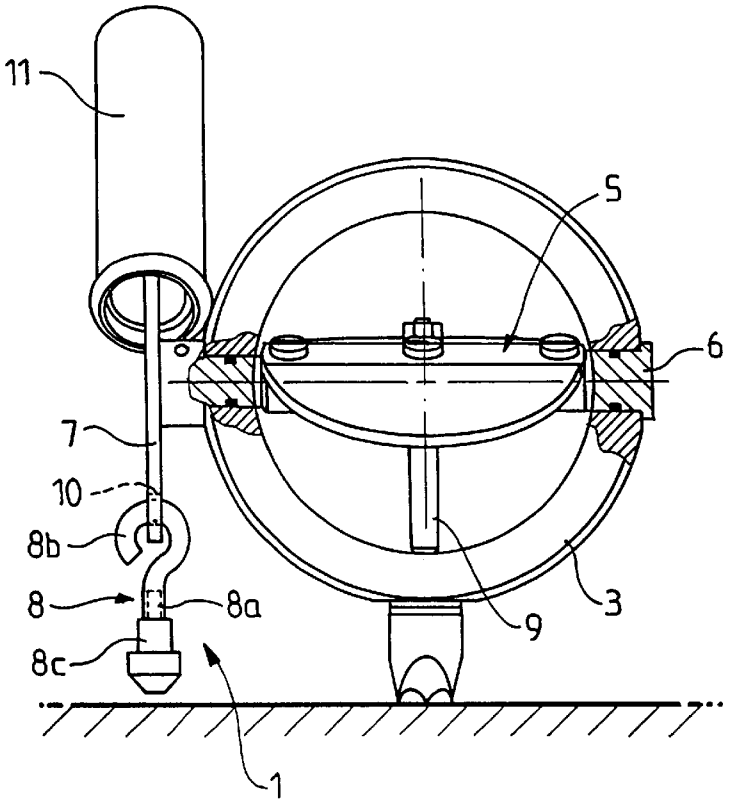
FIG. 2 is an end view, with certain portions removed, of the safety device of the nozzle visible in FIG. 1.

In the form of embodiment illustrated in the drawings, tubular body 3 has a circular cross-section and is diametrically traversed by the pivotal axis of trunnions 6, as clearly shown in FIG. 2.

It goes without saying, however, that it would not be a departure from the scope of the present invention if the cross-section of tubular body 3 were to be of another shape and/or if the pivotal axis of the trunnions were not diametral.

Safety device 1 includes, moreover, an exterior control lever 7 integral with one of trunnions 6, and a triggering means 8, borne by the lever and the function of which will be described hereinafter.

Figure 3:
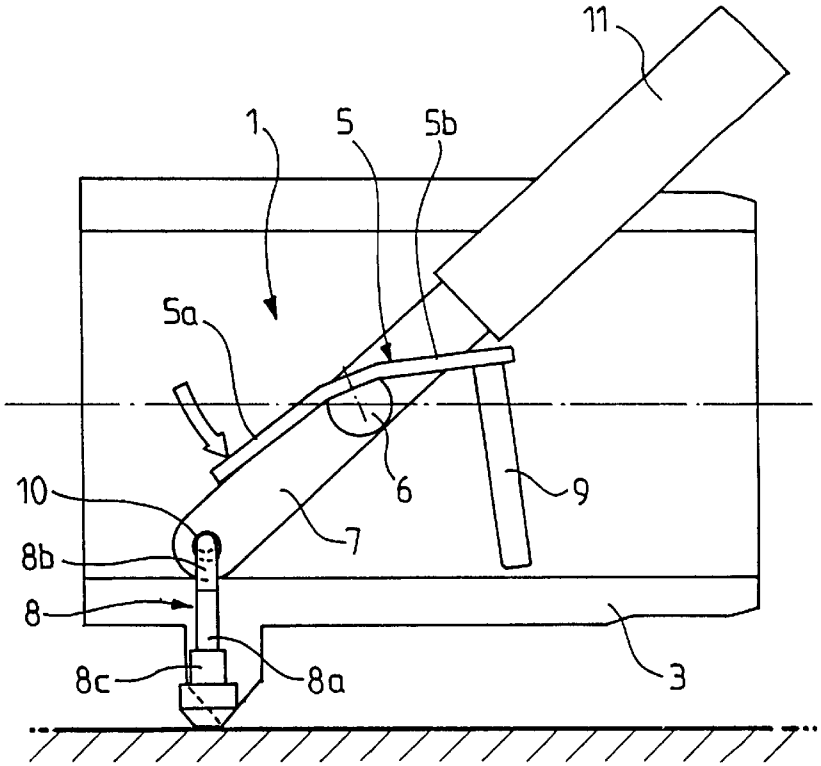
FIG. 3 is a diagrammatic side view of the safety device, showing the butterfly disc in its open position, with the water flowing smoothly through the fire hose nozzle.
Figure 4:
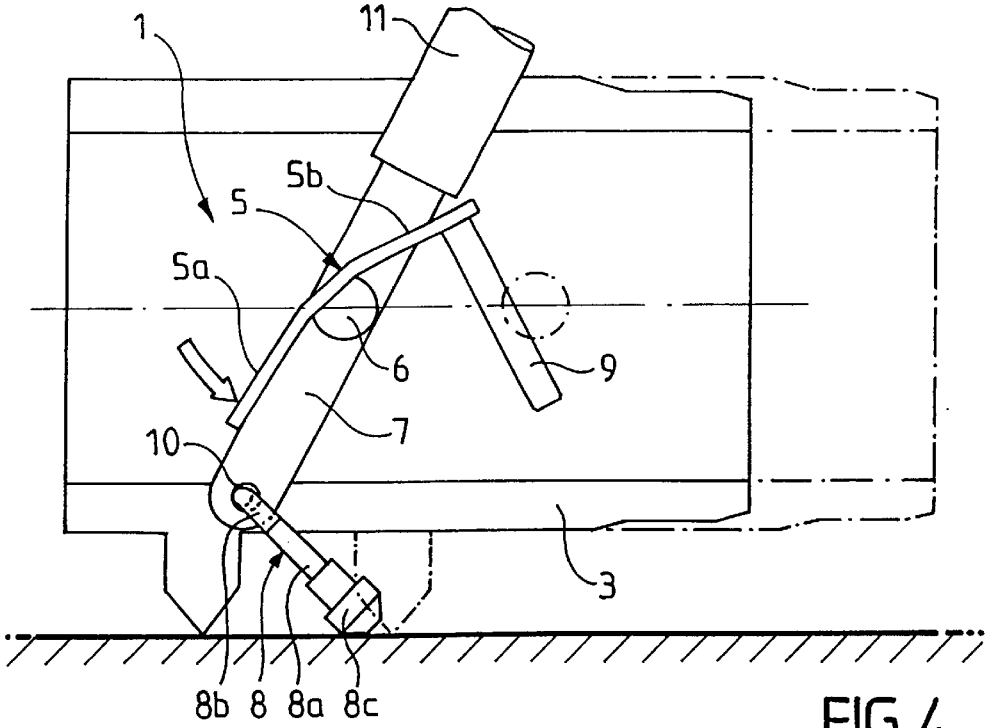
FIG. 4 is a view analogous to that of FIG. 3, but showing the safety device after the occurrence of a pressure surge of the water flowing through the nozzle, the latter having recoiled from its initial position shown in dot and dash lines.
Figure 5:
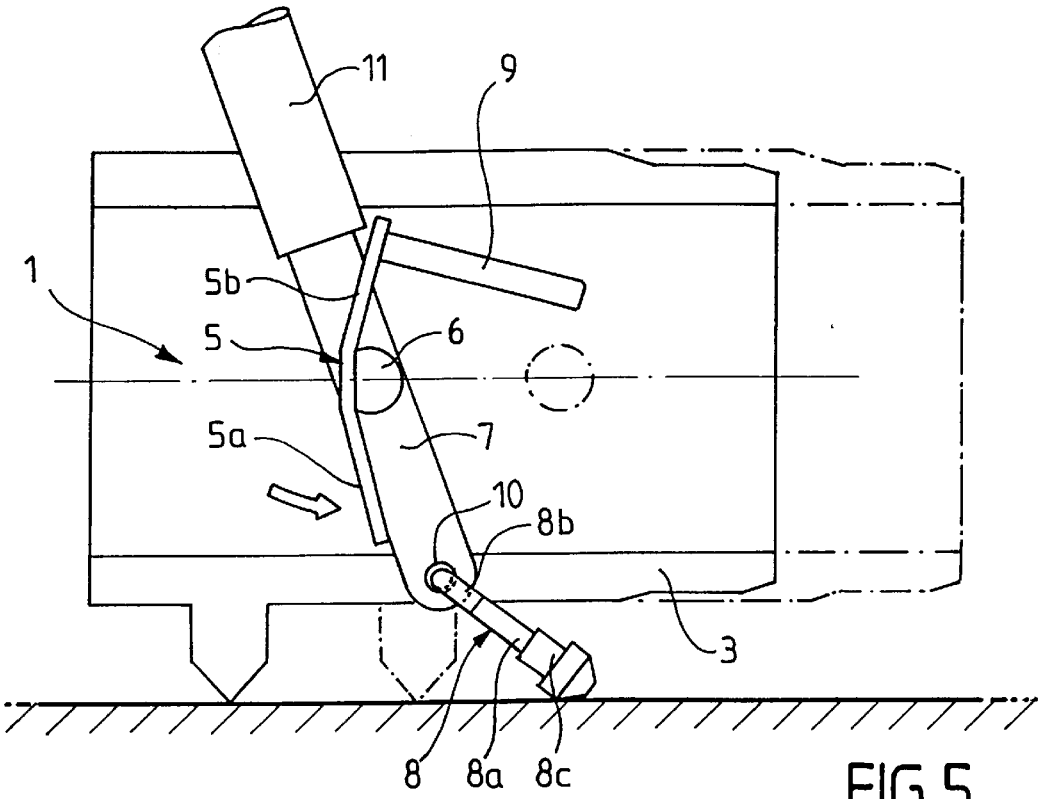
FIG. 5 is a view analogous to that of FIG. 3, but showing the safety device when the butterfly disc is in its closed position, the initial position of the nozzle again being shown in dot and dash lines.

With more particular reference to FIGS. 3 to 5, it will be noted that the part 5*a* of the butterfly disc that is upstream of the pivotal axis of trunnions 6, in relation to flow direction of the water, is directed downwards.

It will also be noted that the downstream part 5*b* of the butterfly disc bears, on its lower face, a stop 9 constituted by a cylindrical rod bearing against the inner face of tubular body 3 when the nozzle is not supplied with water.

In this condition, which is perfectly clear from FIG. 2, stop 9 holds butterfly disc 5 in a rest position in which triggering means 8 is held slightly above the ground.

As clear from FIG. 3, the function of triggering means 8 is to hold butterfly disc 5 in its open position when control lever 7 exerts thereon, through the action of the water flowing over the upstream part 5*a* of the butterfly disc, a vertical force pressing it against the floor.

Its function is also to enable the butterfly disc to take up its closed position immediately the water flowing through tubular body 3 produces a pressure surge causing the fire hose nozzle to move in relation to the ground.

Following this movement, lever 7 ceases, in effect, to exert a vertical force on triggering means 8. Now, as the latter is no longer able to hold butterfly disc 5 in its open position, the water forces it to take up its closed position by exerting on its upstream part 5*a* a downwards directed pressure.

In the form of embodiment illustrated, control lever 7 has, at its end nearest to the ground, an orifice 10 extending parallel to the pivotal axis of trunnions 6.

As to triggering means 8, this comprises a rod 8*a* ending in a hook 8*b* inserted into orifice 10, as well as an end-piece 8*c* screwed onto rod 8*a*, on the side opposed to that of hook 8*b*, and designed to come to bear against the ground when the butterfly disc is in open position.

Triggering means 8 could, of course, be different from the one just described. For example, a ball joint type of device interposed between the lever 7 and end-piece 8*c* could replace rod 8*a* without there being any departure from the scope of the present invention.

Finally, it is pointed out that control lever 7 includes an operating handle 11 at its end opposed to that of triggering means 8, said handle extending obliquely upwards when butterfly disc 5 is in its open position.

There will now be given a brief description of the operation of safety device 1 of the fire hose nozzle according to the invention, when this device is connected to supply hose 2 and the fire hose nozzle is resting on the ground.

First of all, butterfly disc 5 is placed in its rest position by acting on handle 11 in such a way that stop 9 comes to bear against the inner face of tubular body 3, as shown in FIGS. 1 and 2.

The valve (not shown) connecting hose 2 to the water supply source is then opened. When the water flows smoothly through safety device 1, it forces butterfly disc 5 to take up its open position by causing it to pivot in the direction of the arrow in FIG. 3. Once the butterfly disc is in this position, control lever 7 presses triggering means 8 against the ground by exerting thereon a downwards directed vertical force. The butterfly disc remains, as a result, in its open position.

If the water flow rate now sharply varies to such an extent that the fire hose nozzle is forced to move in relation to the ground, lever 7 ceases to act vertically on triggering means 8. As butterfly disc 5 is no longer retained in its open position, the water immediately causes it to pivot until it reaches its closed position shown in FIG. 5.

Once the hose is immobilised on the ground, it suffices to grip operating handle 11 in order to bring the butterfly disc to its rest position illustrated in FIGS. 1 and 2. When this operation is carried out, the water that flows through tubular body 3 then exerts on upstream part 5*a* of the butterfly disc a pressure owing to the action of which the latter takes up its open position illustrated in FIG. 3.

What is claimed is:

1. A fire hose nozzle comprising a safety device (1) for preventing the fire hose nozzle from being displaced due to action of water supplied to the nozzle, characterised in that the safety device includes a tubular body (3) designed to be connected to a water supply hose (2), a butterfly disc (5) including two coaxial trunnions (6) pivotally mounted on the tubular body (3), on a horizontal axis extending perpendicularly to a direction of flow of the water, the butterfly disc being movable inside the tubular body between an open position, in which the butterfly disc allows the water to flow, and a closed position, in which the butterfly disc restricts this flow, an external control lever integral with one of the trunnions (6), and a triggering means (8) borne by the control lever (7) and bearing against a ground surface, holding the butterfly disc (5) in its open position when the control lever exerts thereon, due to the action of the water flowing over the butterfly disc, a downwards directed vertical force.

2. The fire hose nozzle of claim 1, characterised in that the tubular body (3) is traversed by the pivotal axis of the trunnions (6).

3. The fire hose nozzle of claim 1, characterised in that the tubular body (3) has a circular cross-section and is diametrically traversed by the pivotal axis of the trunnions (6).

4. The fire hose nozzle of claim 1, characterised in that the part (Sa) of the butterfly disc (5) that is upstream of the pivotal axis of the trunnions (6), in relation to the direction of flow of the water, is directed downwards.

5. The fire hose nozzle of claim 1, characterised in that it comprises a stop (9) which, when no water is flowing, holds the butterfly disc (5) in a rest position in which the triggering means (8) is removed from the ground.

6. The fire hose nozzle of claim 5, characterised in that the stop (9) is borne by the part (5*b*) of the butterfly disc (5) that is downstream of the pivotal axis of the trunnions (6), in relation to the direction of flow of the water, and bears against the inner face of the tubular body (3) to hold the butterfly disc (5) in its rest position.

7. The fire hose nozzle of claim 6, characterised in that the rod (8*a*) comprises, at its end opposed to that of the hook (8*b*), an end-piece (8*c*) bearing on the ground when the butterfly disc (5) is in open position.

8. The fire hose nozzle of claim 1, characterised in that the control lever (7) is provided with an orifice (10) parallel to the pivotal axis of the trunnions (6), while the triggering means (8) comprises a rod (8*a*) ending in a hook (8*b*) inserted into the orifice of the control lever.

9. The fire hose nozzle of claim 1, characterised in that the control lever (7) includes an operating handle (11) at its end opposed to that of the triggering means (8), with the operating handle extending obliquely upwards when the butterfly disc (5) is in its open position.

* * * * *